US005839604A

United States Patent [19]

Straussman

[11] Patent Number: 5,839,604

[45] Date of Patent: Nov. 24, 1998

[54] LID HAVING FLEXIBLY HINGED WALL PORTIONS AND CONTAINER THEREFOR

[75] Inventor: Moshe Straussman, Ramat Gan, Israel

[73] Assignee: Amraz Ltd., Ashdod, Israel

[21] Appl. No.: 737,795

[22] PCT Filed: May 25, 1995

[86] PCT No.: PCT/US95/06692

§ 371 Date: May 14, 1997

§ 102(e) Date: May 14, 1997

[87] PCT Pub. No.: WO95/32128

PCT Pub. Date: Nov. 3, 1995

[30] Foreign Application Priority Data

May 25, 1994 [IL] Israel ..... 109789

[51] Int. Cl.[6] ..... B65D 41/16

[52] U.S. Cl. ..... 220/789; 220/782

[58] Field of Search ..... 220/789, 780, 220/781, 801, 782, 101, 109

[56] References Cited

U.S. PATENT DOCUMENTS

| | | | |
|---|---|---|---|
| Re. 25,906 | 11/1965 | Livingstone | 220/782 |
| 4,154,354 | 5/1979 | Ryder | 215/330 X |
| 4,334,631 | 6/1982 | Ballester | 220/789 X |
| 4,572,399 | 2/1986 | Bock | 220/789 |
| 4,606,474 | 8/1986 | Dudzik | 220/781 |
| 4,667,842 | 5/1987 | Colins | 220/789 |
| 4,678,082 | 7/1987 | Fillmore | 206/807 X |
| 4,799,602 | 1/1989 | Collins et al. | 220/789 |
| 4,887,735 | 12/1989 | Dudzik | 220/789 |
| 4,998,642 | 3/1991 | Kraus | 220/789 X |

FOREIGN PATENT DOCUMENTS

| | | | |
|---|---|---|---|
| 446026 | 9/1991 | European Pat. Off. | 220/101 |
| 2245549 | 1/1992 | United Kingdom | 220/101 |

*Primary Examiner*—Stephen K. Cronin
*Assistant Examiner*—Robin A. Hylton
*Attorney, Agent, or Firm*—Pollock, Vande Sande & Amernick

[57] ABSTRACT

A lid for a container having an inner rim (12) extending around the top of side wall (16) includes a substantially flat central portion (4), a trough-shaped edge portion **(14*a*) comprising rigid inner wall (15*a*) and outer wall (17*a*) connected by a bridge element (19*a*), and a sealing ring (18*a*) on the outer wall (17*a*) for sealingly engaging the inner rim (12) of the container. The central portion (4) is hingedly connected to the inner wall (15*a*) via hinge (5), and the bridge element (19*a*) is rigid and hingedly connected to both the inner wall and the outer wall at its terminal ends (38, 40)**, so that when a vertical force is applied to the lid from inside the container, the bridge element translates the vertical force exerted on the under side of the lid into a lateral force exerted on the outer wall of the edge portion, thus maintaining the seal between lid and container.

7 Claims, 4 Drawing Sheets

LID HAVING FLEXIBLY HINGED WALL PORTIONS AND CONTAINER THEREFOR

FIELD OF THE INVENTION

The present invention relates to plastic containers with inwardly projecting rims and particularly to lids for sealing such containers. The invention also relates to a method of sealing plastic containers to prevent spillage when dropping the container of knocking it over.

BACKGROUND OF THE INVENTION

Traditionally paint cans were made of metal having an invented rim, with a metal plug lid providing the closure. In recent years plastic paint containers have come on the market, which provide obvious advantages such as non-rusting, dent resistance and make them suitable for both water and solvent based paints. These containers are also easier to manufacture. One recent patent, U.S. Pat. No. 4,572,399, discloses such a plastic container having inwardly projecting rims. This type of container has an advantage in that it provides a larger area for labelling or advertising and furthermore prevents liquid in the container from splashing over when moving the container, as for example from the filling station to the lidding station. One problem that these containers have not yet overcome is that they are prone to leakage when they are dropped of knocked over. This is due to the fact that the generally round body of the container is distorted upon impact with the ground, thus also distorting the configuration of the mouth of the container, for example from a round shape to an oval shape, with a longer diameter in one direction. The lid, on the other hand, which is subjected to pressure from inside the container, does not distort in the same fashion, thus leaving an opening between the lid edge and the container wall for the contents to leak out and often the lid pops out completely spilling the whole contents. One solution to this problem is to make the inwardly pointing rim larger, i.e. to point more inwardly, but this would make it difficult to close and open the container.

SUMMARY OF THE INVENTION

It is the object of the present invention to provide plastic containers with inwardly projecting rims which are sealed more securely to prevent their opening and spilling upon impact, particularly lateral impact.

It is a further object of the invention to provide plastic containers which are sealed and opened more easily.

Yet another object of the invention is to provide lids for plastic containers with inwardly projecting rims which provide a better seal and render the container spill-proof on impact, especially lateral impact.

Still another object of the invention is to provide a method for sealing containers to prevent spillage on dropping or falling over to the ground.

BRIEF DESCRIPTION OF THE DRAWINGS

The present invention will be more fully understood and appreciated from the following detailed description taken in conjunction with the drawings, in which.

DETAILED DESCRIPTION OF THE INVENTION

Figure 1A:
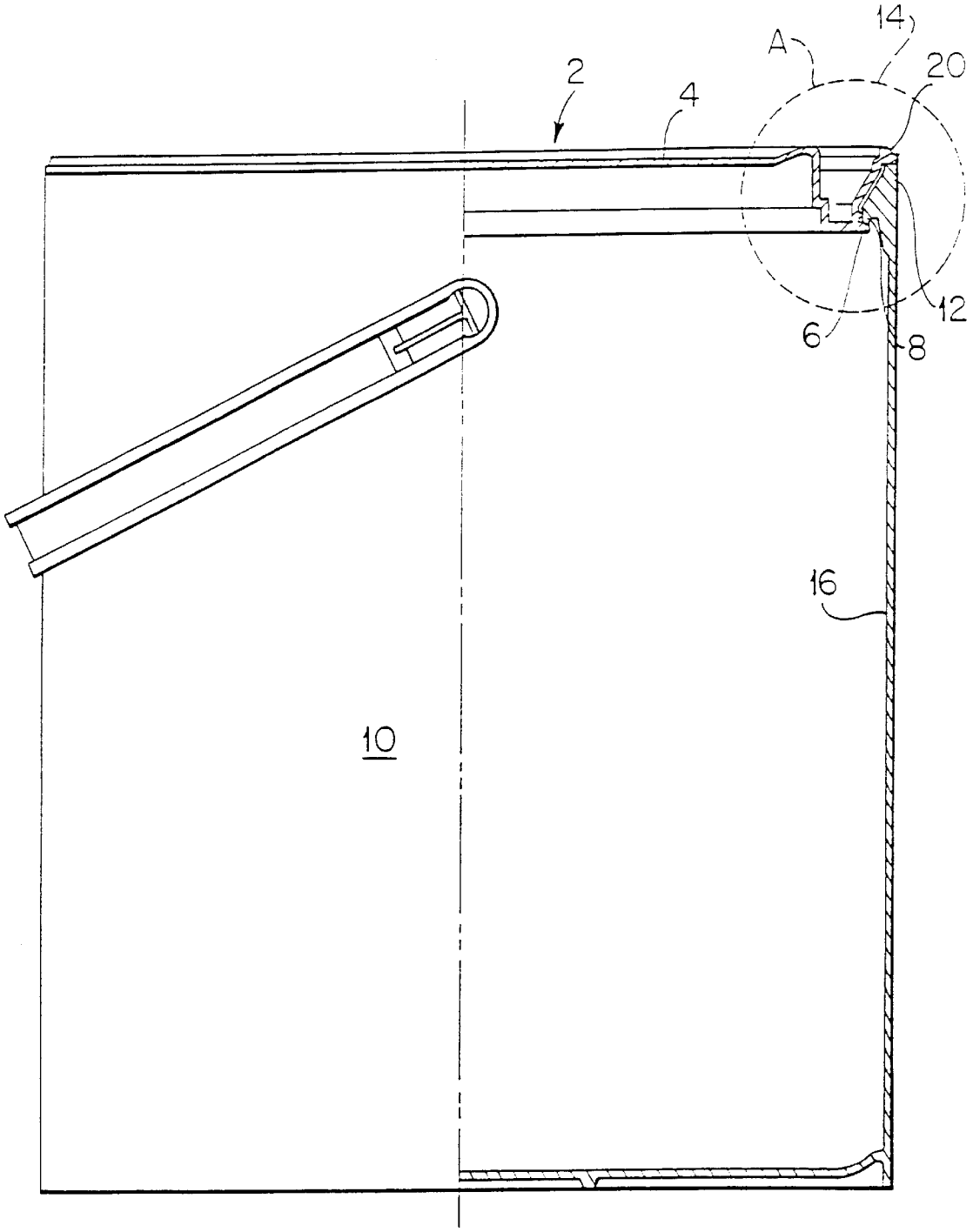
FIG. 1*a* is a sectional elevational view of a lidded container in accordance with the prior art.
Figure 1B:
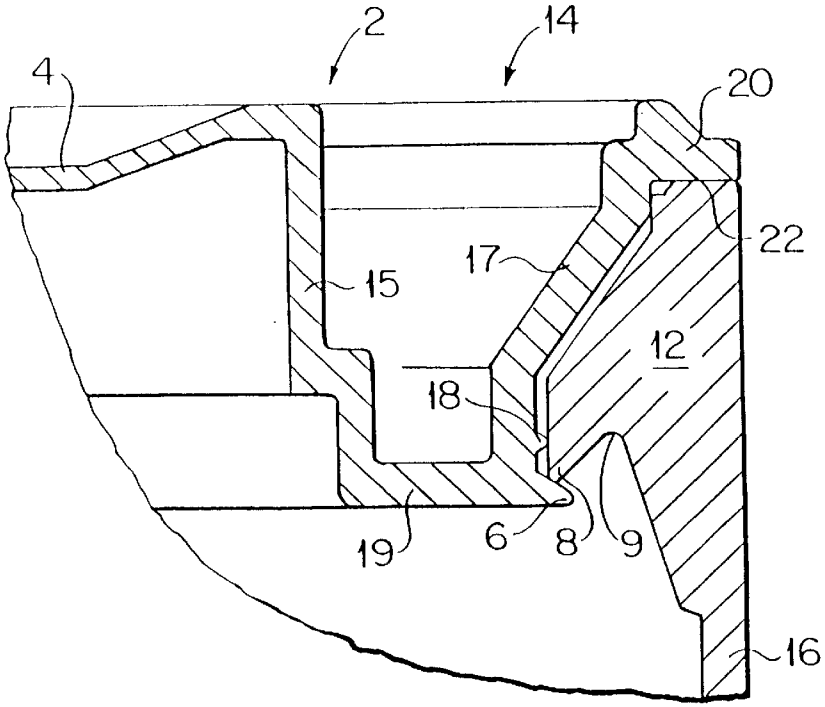
FIG. 1*b* is a blown-up detailed view of section A in FIG 1*a;*

Referring now to FIGS. 1*a* and 1*b*, these represent a prior art container 10, generally round in configuration and having a snap-fit lid 2. The closure between lid 2 and container 10 is as follows. Wall 16 of the container 10 has an upper rim 12 extending around the inner wall of the container. This rim 12 is thicker than wall 16 and includes a top edge 22 and a lower lip 8, which forms a groove 9 in the rim 12. Lid 2 comprises a flat round central portion 4, from which there extends around the entire lid an edge portion 14 which is generally trough shaped. This edge portion 14 comprises an inner wall 15 and an outer wall 17, which are connected at the bottom of the walls 15 and 17 by a fixed bridging element 19. A circumferential flange 6 at the lower end of wall 17 is adapted to engage the lower lip 8 of rim 12. The lid 2 is thus closed on the container 10 by pressing the lid 2 downwards into the container, thereby snapping flange 6 under lip 8 and at the same time contacting upper end 20 of wall 17 with upper edge 22 of rim 12. To ensure a tight seal, a sealing ring 18 (FIG. 1*b*) is provided on wall 17, which presses against rim 12 when the lid is closed. This particular configuration of the edge portion 14 with a fixed element 19 bridging walls 15 and 17, provides sufficient resilience so that flange 6 can undergo lateral displacement either when closing the lid by pressing downward of by prying the lid open with a sharp instrument inserted between the upper end 20 of the outer wall and top edge 22 of rim 12. This prior art container 10, however, has serious deficiencies, one of which is that the container is not spill-proof when knocked over of falls from a stack of containers and impacts the ground. In such a case, the contents of the container press against the inner surface of lid 2, creating a force pushing the lid outward from the container. This outward force causes the trough-shaped edge portion 14 to flex and pull walls 15 and 17, including flange 6, inwardly into the interior of the container, disengaging it from lower lip 8 of rim 12, thereby creating an opening for spillage of the container contents. If the force against the container lid from inside the container is sufficiently great, the entire lid is subject to being pushed out. One way of overcoming this problem is by making the rim 12 wider. This, however, creates a different problem, by making it more difficult to open the lid under normal use conditions or to close the lid after filling the container in the factory, or reclosing the lid after use the first time.

Figure 2B:
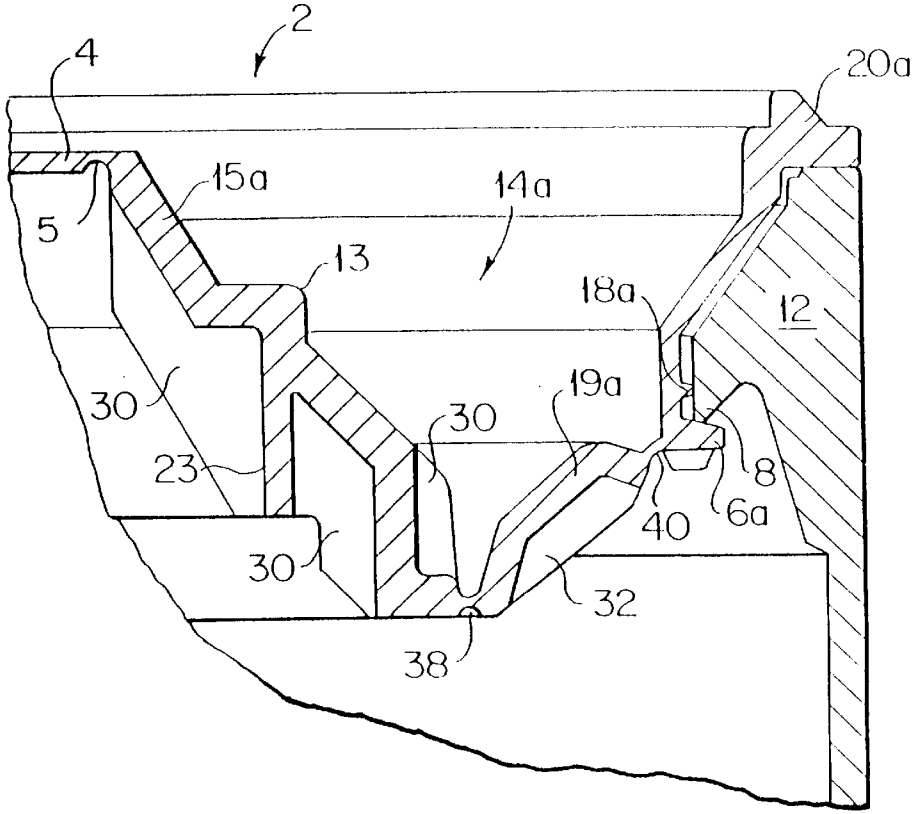
FIG. 2*b* is a blown-up detailed view of section B in FIG. 2*a;*.
Figure 2A:
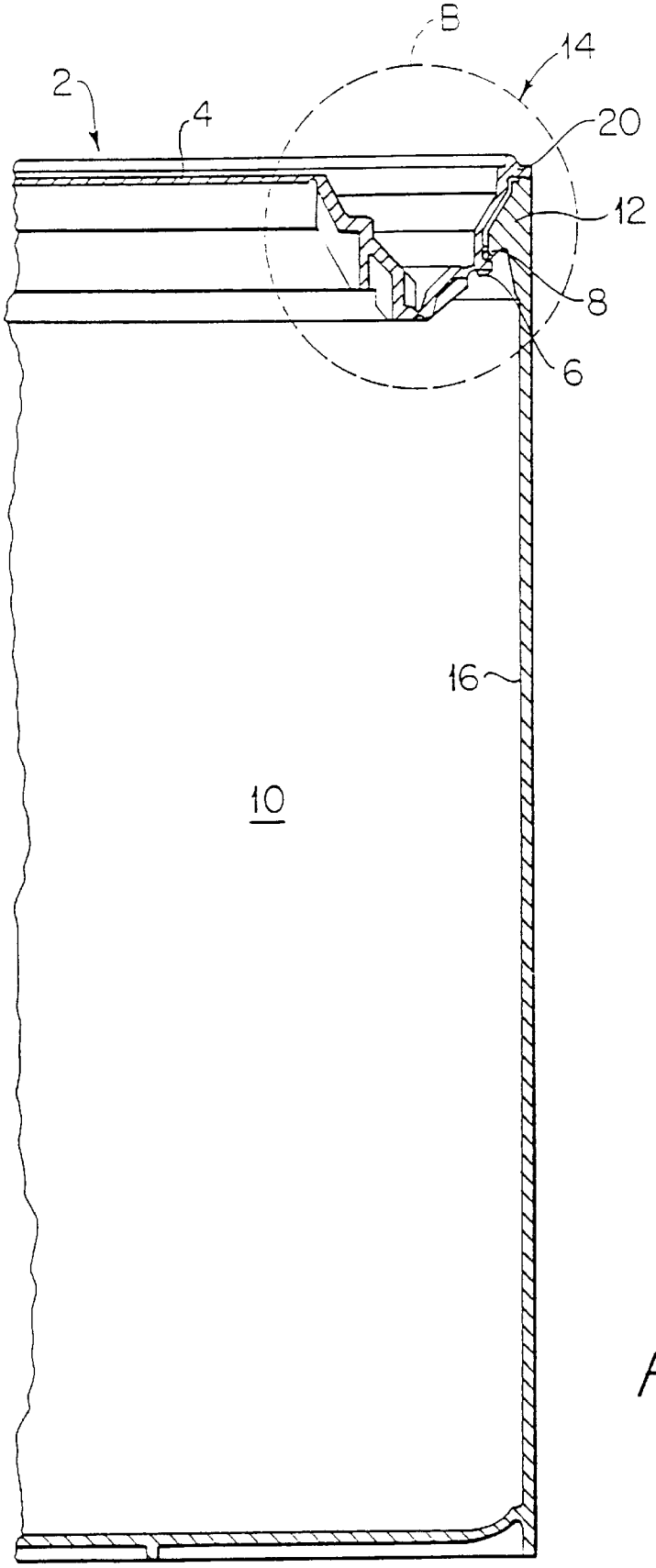
FIG 2*a* is a sectional elevational view of a lidded container in accordance with the invention.
Figure 3:
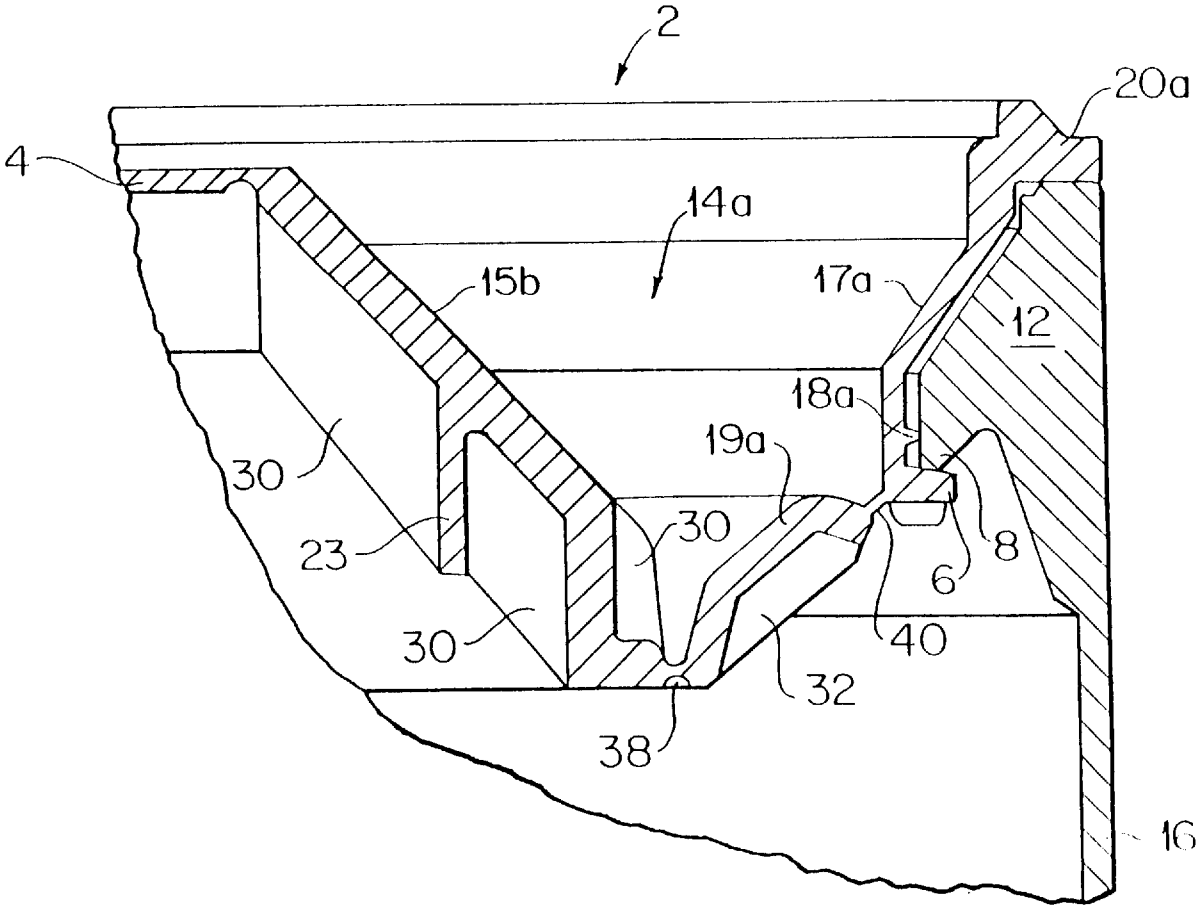
FIG. 3 is a blown-up section view of a lid closure in accordance with an alternative embodiment of the invention.

Referring now to FIG. 2*a* and 2*b*, there is illustrated a container with a lid in accordance with one embodiment of the present invention. The container 10 is the same as shown in FIG. 1*a* having an internal rim 12 with lower lip 8. The lid, however, is different. In this embodiment the lid 2*a* has a similarly flat round central portion 4 which is connected to a generally trough-shape edge portion 14 *a* via circumferential hinge 5. This edge portion 14*a* is different from the prior art and enables easier opening and closing of the container than was previously possible and furthermore provides resistance to accidental opening of the lid and spillage when the container is subjected to impact, for example falling of being knocked over. The edge portion 14*a* of lid 2*a* is comprised of a rigid inner wall 15 *a* and exterior wall 17*a* with a diagonal bridging element 19*a* between them. This bridging element 19*a* is hingedly connected at its terminal ends 38 and 40 to walls 15*a* and 17*a* respectively. Walls 17*a* in the present instance can be made thinner than wall 17 of the prior art lid shown in FIGS. 1*a* and 1*b*. The inner wall 15*a* is made rigid by providing radial reinforcing ribs 30. Similarly, bridging element 19*a* is made rigid by providing periodic reinforcing ribs 32. The outer wall 17*a* comprises an upper lip 20*a*, flange 6*a* and sealing ring 18*a* similar to the corresponding elements in FIGS. 1*a* and 1*b*. The lid of this invention as illustrated in FIGS. 2*a* and 2*b*. is easier to close and to open and is more resistant to spilling of contents when the container is subjected to impact, such as by falling, especially lateral impact on the side of the container. This is because when the contents of the container 10 upon impact exert a force on the lid 2*a* from inside the container, the rigid wall 15*a* is displaced upwardly via hinge 5 towards the opening of the interior of the container 10. The outer wall 17*a*, however, remains firmly attached to the rim 12, because diagonal bridging element 19*a*, which is connected to wall 15*a* by means of hinge 38 and to wall 17*a* by means of hinge 40, translates the upward force exerted on wall 15*a* to a lateral component and adjusts itself between walls 15*a* and 17*a* to provide lateral outward displacement of flange 6*a* which remains engaged with lip 8 to keep the seal between lid 2 and wall 16 intact. Moreover, even is side wall 16 were to be displaced outwardly from the container, the hinged diagonal bridging element 19*a* would displace wall 17*a* in the same outward direction, while maintaining its grip on rim 12. Wall 15*a* has at its approximate center a ledge 13 with a vertically downward extending rib 23 circling the under side of the lid. The circumferential rib 23, together with the radial rib 30, provide the required rigidity to wall 15*a*. Step 13 is more for design purposes for better stacking of lids and not essential to the invention as is shown in FIG. 3, which shows another embodiment of the lid having a straight inner wall 15*b*.

It is to be appreciated by persons skilled in the art that the scope of the present invention is not limited to what has been shown and described above merely by way of example. The scope of the present invention is limited rather solely by the claims which follow.

I claim:

1. A lid for containers having an inner rim along the perimeter of the container wall, said lid comprising:

a substantially flat central portion, a trough-shaped edge portion comprising a rigid inner wall, a rigid outer wall and a rigid bridge element connecting the inner and outer walls, the central portion, inner wall, outer wall and bridge element having respective defined thicknesses, means disposed on the outer wall for sealingly engaging the inner rim of the container, characterized in that the central portion of the lid is integrally and flexibly hinged to the inner wall of the edge portion, and the bridge element is integrally and flexibly hinged to both the inner wall and the outer wall, said integral and flexible hinges are of a thickness less than the respective thicknesses of the elements that they connect, so that when a vertical force is applied to the lid from inside the container, the rigid bridge element translates the vertical force exerted on the under side of the lid into a lateral force exerted on the rigid outer wall of the edge portion, thus maintaining the seal between said lid and said container.

2. A lid as in claim 1 wherein the inner wall is longer than the outer wall and the bridge element connecting these walls is diagonal.

3. A lid as in claim 1 wherein the inner wall comprises reinforcing ribs.

4. A lid as in claim 1 wherein the bridging element comprises integrally molded reinforcing ribs.

5. A lid as in claim 1 wherein the outer wall comprises a sealing ring.

6. A sealed container comprising a container having a rim along the inner perimeter of the container wall and a lid comprising a substantially flat central portion, a trough-shaped edge portion comprising a rigid inner wall, a rigid outer wall and a rigid bridge element connecting the inner and outer walls, the central portion, inner wall, outer wall and bridge element having respective defined thicknesses, means disposed on the outer wall for sealingly engaging the inner rim of the container, characterized in that the central portion of the lid is integrally and flexibly hinged to the inner wall of the edge portion, and the bridge element is integrally and flexibly hinged to both the inner wall and the outer wall, said integral and flexible hinges are of a thickness less than the respective thicknesses of the elements that they connect, so that when a vertical force is applied to the lid from inside the container, the rigid bridge element translates the vertical force exerted on the under side of the lid into a lateral force exerted on the rigid outer wall of the edge portion, thus maintaining the seal between said lid and said container.

7. A method of sealing a container having an inner rim along the perimeter of the container wall, with a plastic lid, comprising snap fitting a lid onto a container having an inner rim along its perimeter said lid comprising a substantially flat central portion, a trough-shaped edge portion comprising a rigid inner wall, a rigid outer wall and a rigid bridge element connecting the inner and outer walls, the central portion, inner wall, outer wall and bridge element having respective defined thicknesses, means disposed on the outer wall for sealingly engaging the inner rim of the container, characterized in that the central portion of the lid is integrally and flexibly hinged to the inner wall of the edge portion, and the bridge element is integrally and flexibly hinged to both the inner wall and, the outer wall, said integral and flexible hinges are of a thickness less than the respective thicknesses of the elements that they connect, so that when a vertical force is applied to the lid from inside the container, the rigid bridge element translates the vertical force exerted on the under side of the lid into a lateral force exerted on the rigid outer wall of the edge portion, thus maintaining the seal between said lid and said container.

* * * * *